US005649522A

United States Patent [19]

Troncoso

[11] Patent Number: 5,649,522

[45] Date of Patent: Jul. 22, 1997

[54] ADJUSTABLE COMBINATION PULLEY AND CAM WHEEL DEVICE AND COMPOUND ARCHERY BOW INCORPORATING THE SAME

[76] Inventor: Vincent Troncoso, 14090-6100 Rd., Montrose, Colo. 81401

[21] Appl. No.: 517,058

[22] Filed: Aug. 21, 1995

[51] Int. Cl.[6] ..... F41B 5/10

[52] U.S. Cl. ..... 124/25.6; 124/900

[58] Field of Search ..... 124/25.6, 900

[56] References Cited

U.S. PATENT DOCUMENTS

| | | | |
|---|---|---|---|
| 4,337,749 | 7/1982 | Barna | 124/86 X |
| 4,515,142 | 5/1985 | Nurney | 124/25.6 |
| 4,519,374 | 5/1985 | Miller | 124/25.6 |
| 4,967,721 | 11/1990 | Larson | 124/25.6 |
| 5,040,520 | 8/1991 | Nurney | 124/25.6 |
| 5,301,651 | 4/1994 | LaBorde et al. | 124/25.6 |
| 5,368,006 | 11/1994 | McPherson | 124/25.6 |

*Primary Examiner*—John A. Ricci
*Attorney, Agent, or Firm*—Donald E. Nist

[57] ABSTRACT

The adjustable combination pulley and cam wheel device is used on the compound archery bow of the present invention. The wheel device includes a circular disc-shaped round wheel which has an elongated slot extending transversly therethrough from one side to the other and intersecting the transverse center axis of the wheel. Supplemental slots may also be provided. A pair of brackets releasably secure an axle sleeve to the wheel through the slot in any desired location, so that it can be used as a simple pulley or cam. A transverse axle is secured to the upper bow limb through the axle sleeve. The wheel has a pair of spaced peripheral string grooves, in one of which is trained the upper end of a bowstring and in the other of which is trained the upper end of a return string. The string upper ends are releasably secured in hooks on opposite sides of the wheel, while the string lower ends are releasably secured to a cam which includes a bowstring-receiving hatchet-shaped disc along the longidutinal centerline of the bow, a return string ear-shaped disc rigidly connected to the hatchet-shaped disc on one side thereof, and a harness string-receiving C-shaped removeable module rigidly connected to the opposite side of the hatchet-shaped disc. The upper end of the harness string is bifurcated and connected to opposite sides of upper axle. The cam is eccentrically connected to a transverse axle connected to the lower bow limb. The cam is balanced against limb torque.

11 Claims, 4 Drawing Sheets

FIG. 5
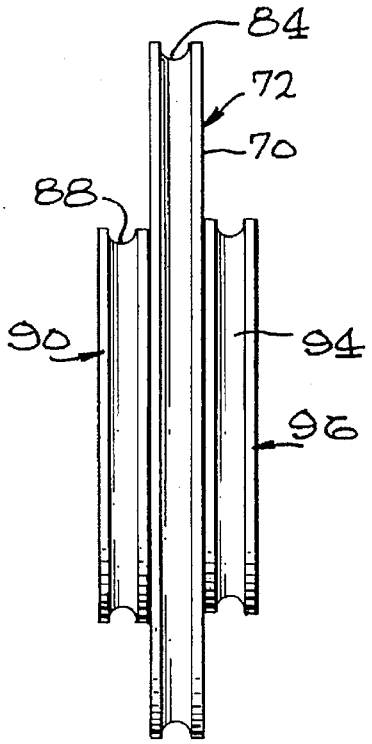
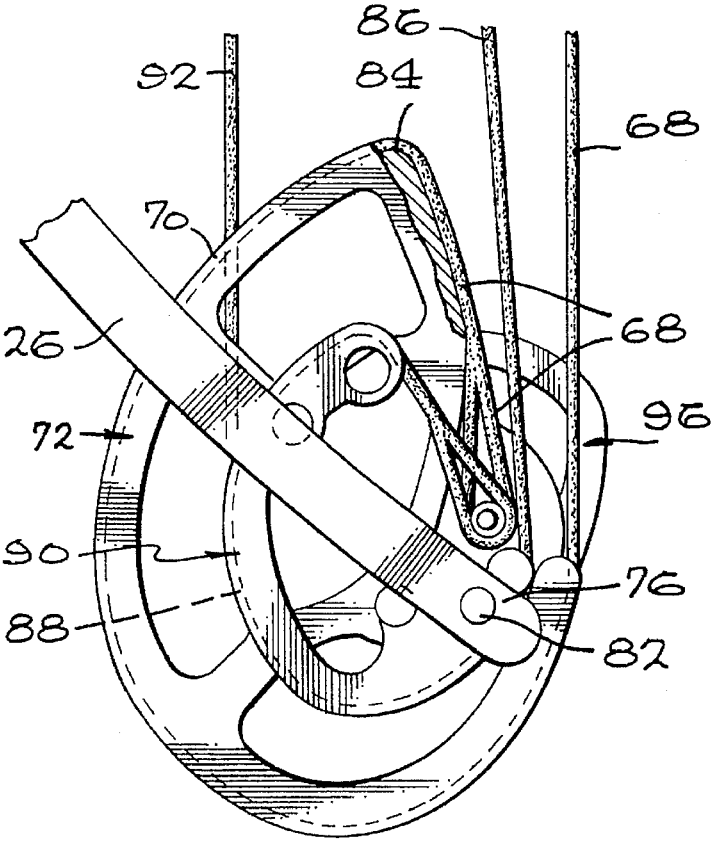
FIG. 6
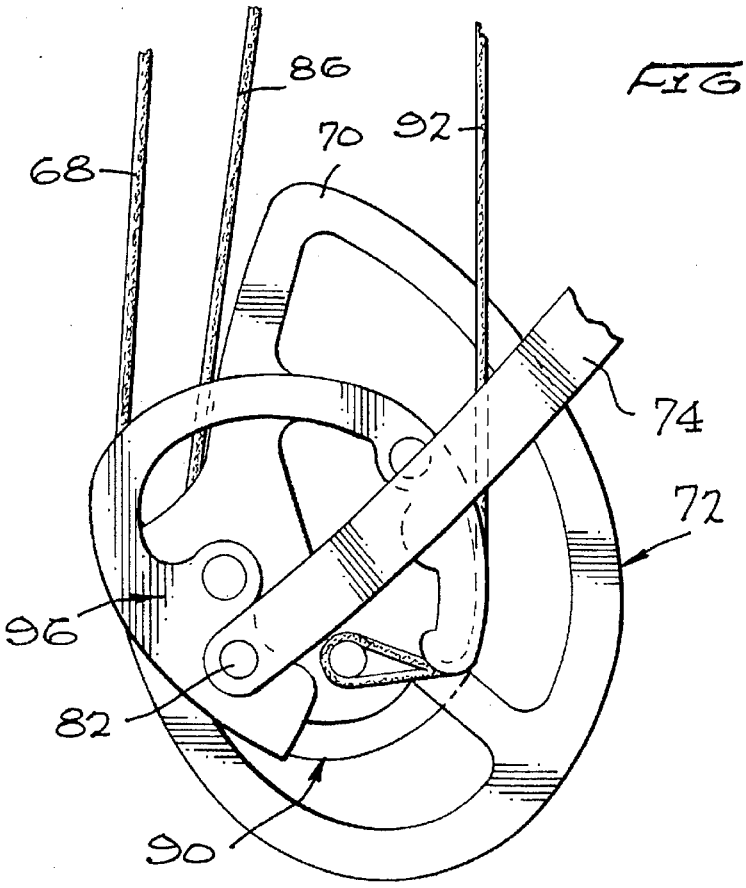
FIG. 7

FIG. 8
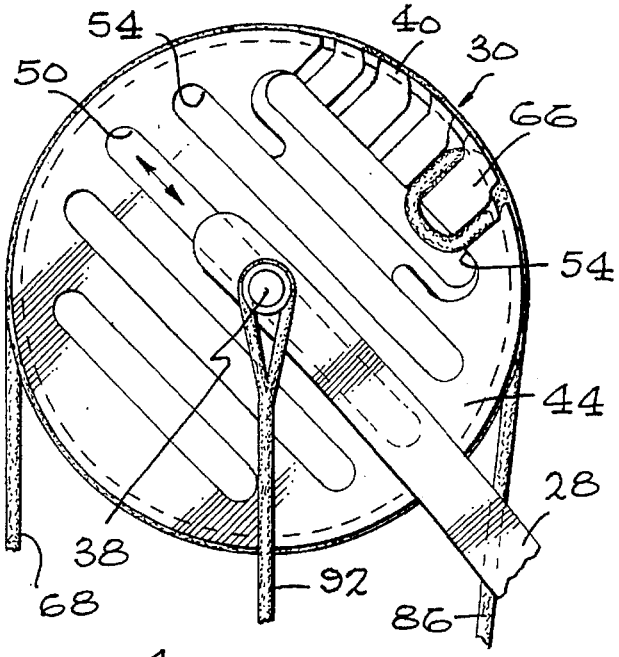
FIG. 11
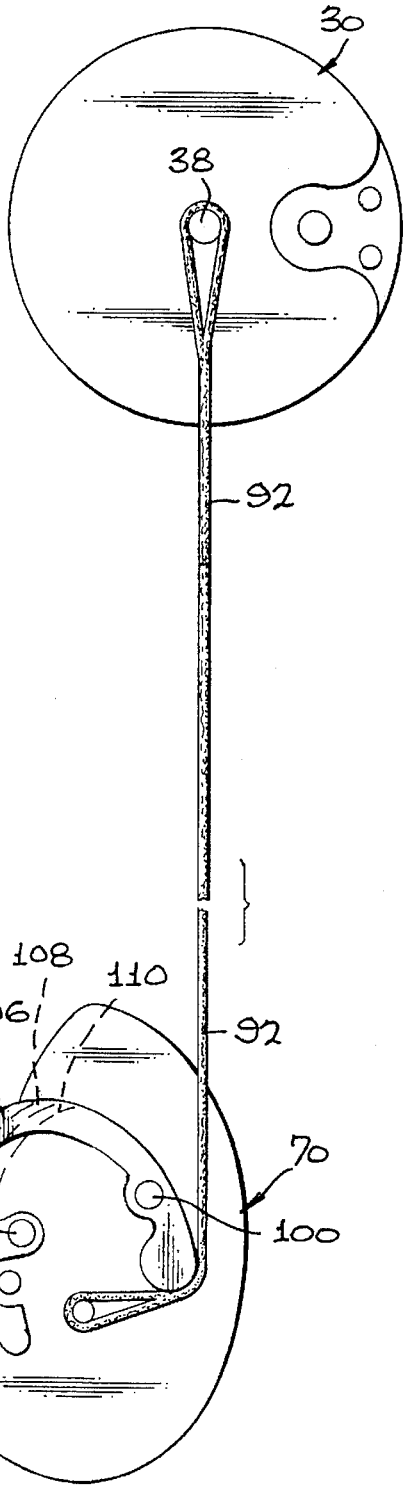
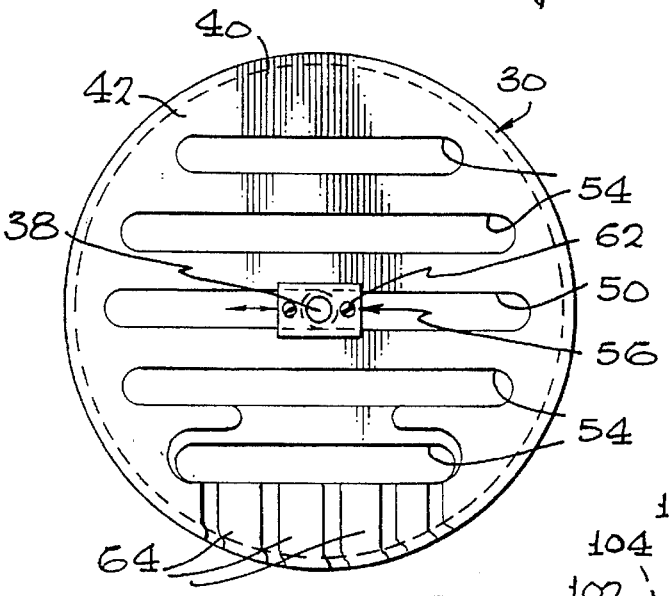
FIG. 12
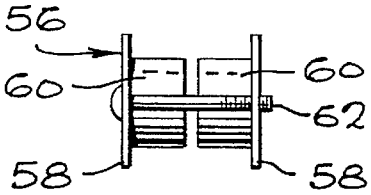
FIG. 13

ADJUSTABLE COMBINATION PULLEY AND CAM WHEEL DEVICE AND COMPOUND ARCHERY BOW INCORPORATING THE SAME

BACKGROUND OF THE INVENTION

1. Field of the Invention

The present invention generally relates to sports and hunting equipment and more particularly to an improved compound archery bow and a combination pulley and cam wheel for the same.

2. Prior Art

Compound archery bows have been devised to provide accurate shooting bows which have a lowered draw weight at full extension of the bowstring, in comparison with the draw weight necessary to pull the bowstring to the full draw position. This is accomplished by providing the bow with one or more cammed elements at one or both bow limb tips and/or at points therebetween.

When two or more cammed elements are used on the bow, the problem has been in properly adjusting the elements so that equal tension is applied to both bow limbs during drawing of the bowstring. Certain newer forms of compound archery bows have employed single cams at one end of the bow to avoid the just-described balancing problem. However, in most instances, torquing, that is, sideways twisting of one or both bow limbs has resulted, with consequential ultimate failure of the bow limbs and also less than desireable shooting characteristics for the compound bow.

A single cam compound archery bow is exemplified by that disclosed and claimed in U.S. Pat. No. 5,368,006. That bow utilizes a single long combination bowstring and return string which wraps around a top single track round pulley wheel and the opposite ends of which are connected to separate elements of a bottom cam. One of the difficulties with that bow is that when the string needs to be replaced, it is expensive and sometimes difficult to obtain a suitable substitute string, due to its unusually great length.

Moreover, commercial versions of the bow of that patent employ an anchor cable, one end of which is connected to the tip of the upper bow limb and the opposite end of which is connected to a grooved element on one side of the cam, the same side to which one end of the long combination bowstring and return string is attached. The opposite end of the combination bowstring and return string is attached to the main portion of the cam, which is aligned along the longitudinal axis of the bow. With this arrangement, when the bowstring is drawn, there is a torquing or twisting effect on the lower bow limb and to some extent also on the upper bow limb, with consequent strain on the bow.

Accordingly, there is a need for an improved type of compound archery bow which avoids all torquing of the bow limbs and which affords the archer an opportunity with the elements already installed on the bow of adjusting the bow for a two cam or one cam effect. There is also a need for a combination adjustable pulley and cam wheel device which can impart to the bow the described selective two or one cam effect. There is a further need for an improved compound archery having the described characteristics and which employs a bowstring of normal easily replaceable length.

SUMMARY OF THE INVENTION

The improved combination pulley and cam wheel device of the present invention and the compound bow incorporating the wheel device satisfy all the foregoing needs.

The device and bow are substantially as set forth in the ABSTRACT OF THE DISCLOSURE. Thus, the device comprises a wheel which is a round flat sided disc having an elongated slot extending transversely therethrough and which intersects the transverse central axis of the wheel. The device also includes bracket means which adjustably position a tranverse axle-receiving sleeve at any desired position along the length of the slot. If the sleeve is positioned at the transverse mid-point of the disc, the wheel functions as a normal pulley. If the sleeve is positioned away from that mid-point, the wheel functions as a cam. The camming effect can be adjusted by adjusting the sleeve position. If desired, additional slots which are preferably parallel to but spaced from the first-described slot can extend transversely through the wheel for selective camming of the wheel.

In the bow of the present invention, the wheel is mounted for rotation on a transverse axle at the tip of the upper bow limb and is aligned with the longitudinal axis of the bow. The wheel has a spaced pair Of string grooves in the periphery of the wheel, one for the bowstring and one for the return string, and the wheel also includes one or more bowstring anchors on bowstring groove side of the disc and one or more return string anchors on the return string side of the disc. This arrangement assures a torque-free functioning of the wheel device on the compound archery bow.

The bow also includes a cam rotatably mounted on a transverse axle at the lower bow limb tip. The cam has a first central element which receives the lower end of the bowstring in a peripheral string groove, a second element rigidly secured to one side of the first element and which receives the lower end of the return string in a peripheral groove, and a third element rigidly secured to the opposite side of the first element and which receives the lower end of a bow limb anchor harness string in a string groove, the upper end of which element is bifurcated and connected to the upper transverse axle. With this arrangement, the three cam elements function as a single unit without torquing either the lower bow limb or the upper bow limb, thereby providing a more durable more accurately shooting compound archery bow.

Further features of the improved combination wheel device and compound archery bow are set forth in the following detailed description and accompanying drawings.

DRAWINGS

FIG. 5 is a schematic rear elevation of the cam of the bow of FIG. 1;

FIG. 6 is a schematic left side elevation, partly broken away, of the cam of FIG. 5;

FIG. 7 is a schematic right side elevation of the cam of FIG. 5;

FIG. 8 is a schematic right side elevation of the wheel device of FIG. 3;

FIG. 11 is a schematic side elevation of the wheel, wheel axle, harness string and harness string-anchoring cam element of the bow of FIG. 1;

FIG. 12 is a side elevation of the wheel device of FIG. 3, showing the bracket means thereof in place on the wheel; and, FIG. 13 is an enlarged end view of the bracket means of FIG. 12.

DETAILED DESCRIPTION

FIGS. 1–13.

Figure 1:
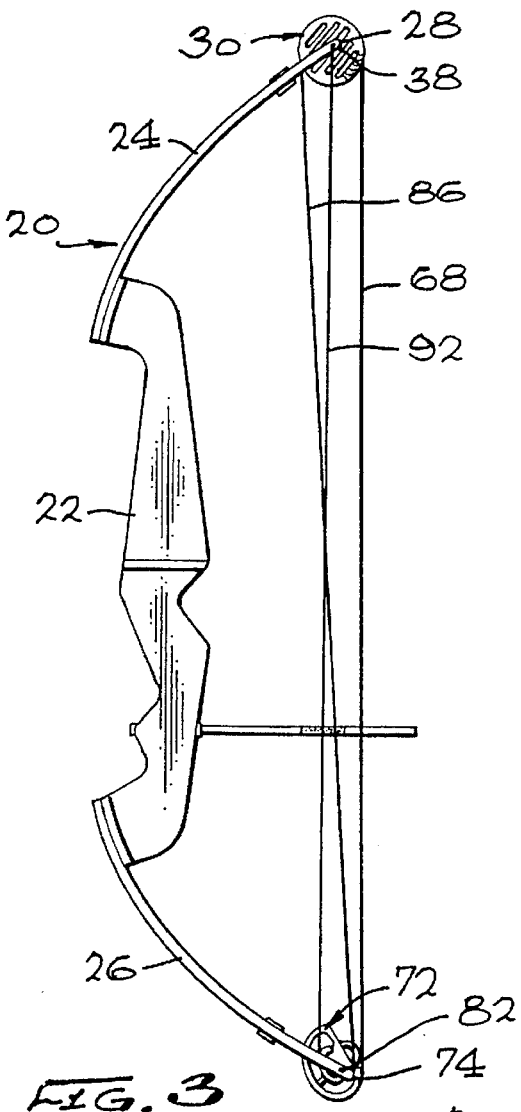
FIG. 1 is a schematic side elevation of a preferred embodiment of the improved compound archery bow of the present invention.
Figure 2:
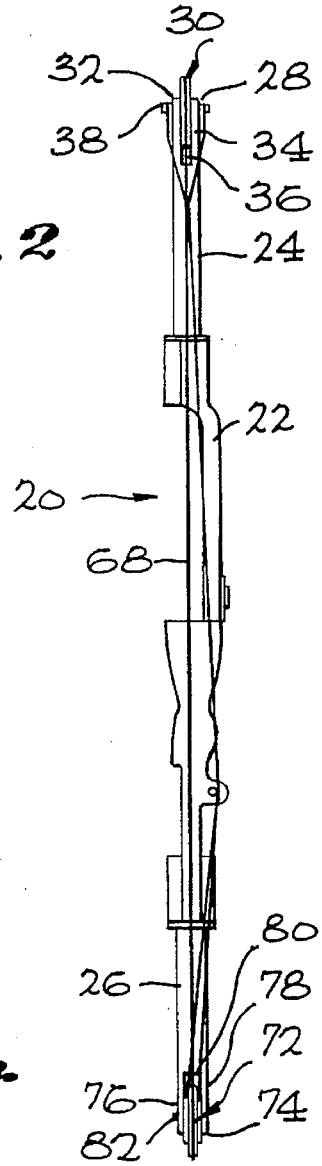
FIG. 2 is a schematic rear elevation of the bow of FIG. 1.
Figure 3:
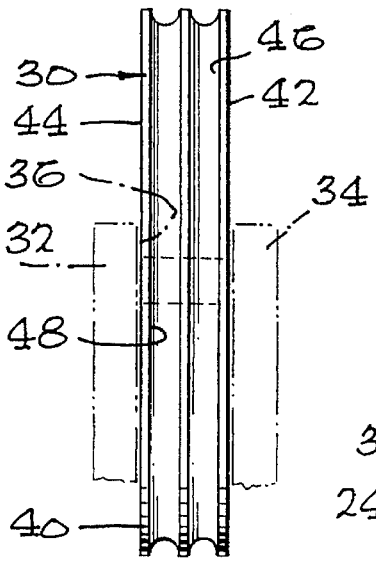
FIG. 3 is a schematic top plan view of a preferred embodiment of the novel combination pulley and cam wheel device of the present invention.
Figure 4:
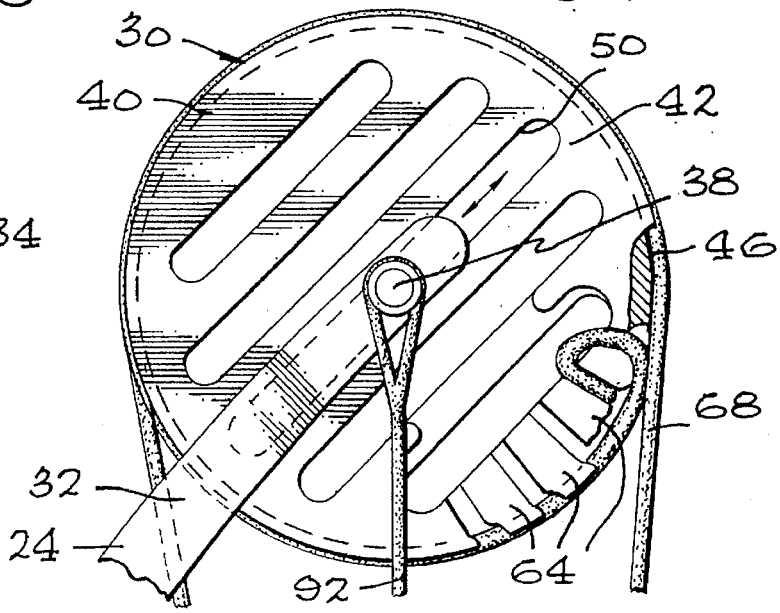
FIG. 4 is a schematic left side elevation, partly broken away, of the wheel device of FIG. 3.
Figure 10:
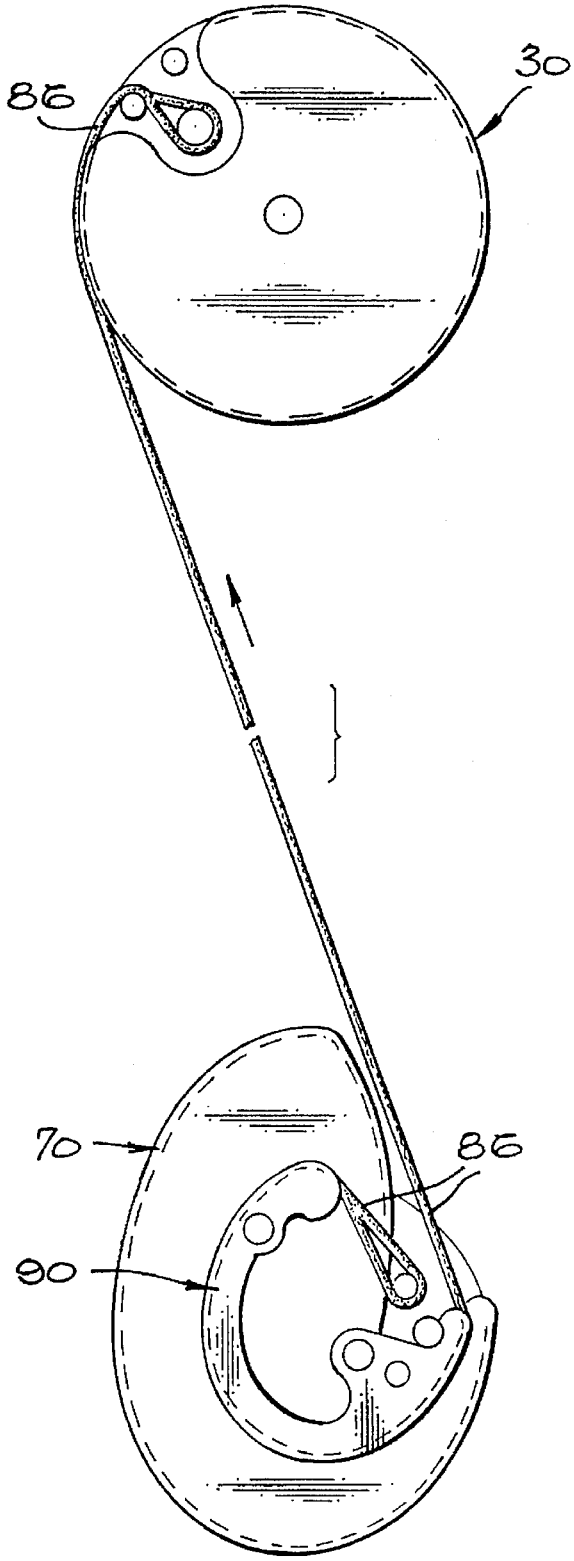
FIG. 10 is a schematic side elevation of the wheel, return string and return string-anchoring cam element of the bow of FIG. 1.
Figure 9:
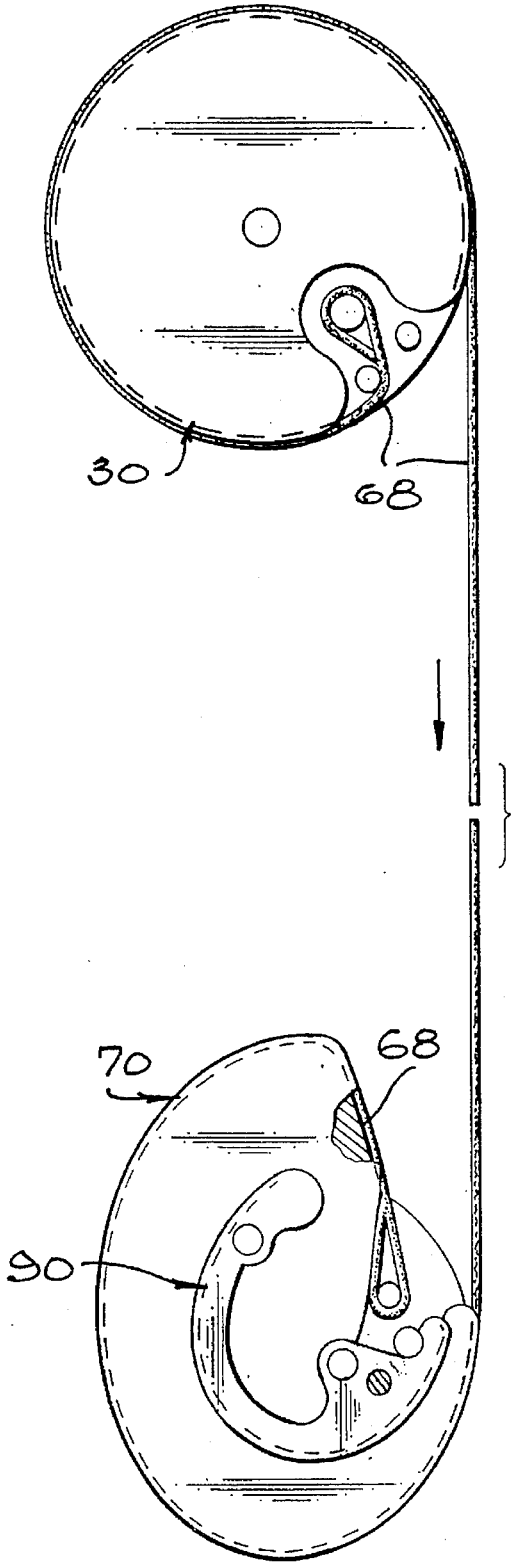
FIG. 9 is a schematic side elevation of the wheel, bowstring and bowstring-anchoring cam element of the bow of FIG. 1.

Now referring more particularly to FIGS. 1–13 of the drawings, a preferred embodiment of the improved compound archery bow of the present invention is schematically depicted therein. Thus, bow 20 is shown which comprises a central riser 22, to the upper end of which is connected an upper bow limb 24 and to the lower end of which is connected a lower bow limb 26.

To the tip 28 of limb 24 is connected a combination pulley and cam wheel device 30 of the present invention. In this regard, tip 28 is bifurcated into two portions 32 and 34 with a space 36 therebetween in which device 30 is secured by a transverse axle 38 to portions 32 and 34 so that device 30 is disposed along the longitudinal axis of bow 20 and rotates therein.

Wheel device 30 is of special configuration. It is a round wheel or disc 40 with flat opposite sides 42 and 44 and bears in the outer periphery thereof (FIG. 3) a spaced pair of parallel string grooves 46 and 48 extending therearound. As shown in FIGS. 12 and 13, device 30 also includes an elongated slot 50 which intersects the transverse central axis of wheel 40 and also has a plurality (in this case 4) supplemental optional elongated slots 54 spaced from but parallel to slot 50. Slots 50 and 54 extend transversely all the way through wheel 40 from side 42 to side 44 thereof.

Device 30 also includes a bracket 56 which comprises a pair of flat plates 58 bearing hollow sleeves 60 extending from one side thereof and which receive axle 38, and screws 62 which releasably tighten plates 58 against sides 42 and 44 in any desired position in slot 50 or one of slots 54, while sleeves are held in an aligned position (FIG. 13) in such slot. Thus, bracket 56 permits the axis of rotation of wheel 40 around axle 38 to be adjusted. When that axis is the transverse center axis of wheel 40, device 30 acts as a simple pulley. When that axis of rotation is in any other location, device 30 acts as a cam. This provdes device 30 with an improved function, enabling an archer to adjust and fine tune bow 20 as he or she desires.

Device 30 also includes a plurality of spaced bowstring anchors 64 on side 42 of wheel 40 which side is closest to bowstring groove 46, while side 44 bears a plurality of similar anchors 66 adjacent return string groove 48.

The upper end of bowstring 68 is releasably secured to a selected anchor 64 and the opposite lower end of bowstring 68 is releasably connected to a hatchet-shaped first cam element 70 in a cam 72 at the tip 74 of lower limb 26. Tip 74 is bifurcated into two portions 76 and 78 separated by a space 80 in which cam 72 is rotatably held by a transverse axle 82 secured to portions 76 and 78. Cam 72 is aligned along the longitudinal axis of bow 20 and cam element 70 rotates in the longitudinal centerline of bow 20. Cam element 70 includes a peripheral string groove 84 in which bowstring 68 is trained.

The upper end of return string 86 is connected to an anchor 66 and the lower end thereof is trained in a peripheral string groove 88 in a second element 90 and releasably secured thereto. Element 90 is rigidly secured to the left side of element 70 and is generally ear-shaped. The upper end of a bow limb anchor harness string 92 is bifurcated and connected to opposite sides of axle 38 while the lower end of string 92 is trained in a groove 94 in C-shaped element 96 rigidly secured to the right side of element 70 by two bolts 98 and 100. String 92 is releasably anchored to element 96. Element 96 can be removed and replaced by similar elements having different curvatures and lengths, as indicated by lines 102, 104, 106, 108 and 110 in FIG. 11 to shorten or lengthen, as desired, the length of string 92 to suit different draw lengths, etc.

Harness string 92 ties bow limbs 24 and 26 together so that they work as a unit. As bowstring 68 is drawn by the archer, its movement is counterbalanced by the movement of return string 86, since both are releasably connected to cam 72 and wheel 40. The camming action of cam 72 is transmitted to bowstring 68 while bow limbs 24 and 26 flex in a unified non-torquing action to provide a superior arrow shooting effect without stressing bow limbs 24 and 26. Accordingly, bow 20 has superior characteristics and is easy and simple to adjust and fine tune.

Further features of the improved wheel device and bow of the present invention are as set forth in the foregoing. Various modifications, changes, alterations and additions can be made in the improved bow, its components and parameters and in the novel combination pulley and cam wheel device of the present invention, its components and parameters. All such modifications, changesa, alterations and additions as are within the scope of the appended claims form part of the present invention.

What is claimed is:

1. An adjustable combination pulley and cam wheel device for a compound archery bow, said wheel device comprising, in combination:

a) a circular disc-shaped wheel having generally flat sides and an outer periphery defining at least one peripheral string groove, said sides defining an elongated slot extending transversely therethrough, said slot intersecting the transverse central axis of rotation of said wheel; and, b) a bracket releasably connected to said sides and defining a repositionable tranverse axle sleeve, whereby the axis of rotation of said wheel is adjustable.

2. The device of claim 1 wherein said wheel sides also define at least one supplemental slot which does not intersect the axis of rotation of said wheel and which extends transversely through said sides.

3. The device of claim 2 wherein said wheel includes a plurality of said supplemental slots spaced from and parallel to said slot which intersects said transverse central axis of rotation of said wheel.

4. The device of claim 3 wherein said wheel includes a spaced pair of peripheral string grooves in the outer periphery of said wheel and wherein each of said wheel sides defines at least one string anchor.

5. The device of claim 4 wherein said wheel comprises metal and wherein said bracket comprises a pair of flat plates, each said plate having a tubular axle-receiving sleeve extending transversely from one side thereof and in communication with an axle-receiving opening in said plate, said bracket further including a screw for releasably interconnecting said plates.

6. An improved compound archery bow, said bow comprising, in combination:

a) a generally central riser;

b) an upper bow limb connected to said riser and extending above said riser;

c) a lower bow limb connected to said riser and extending below said riser;

d) a combination pulley and cam wheel device comprising a disc-shaped circular wheel rotatably secured by a transverse axle to the upper end of said upper bow limb for rotation therearound along the longitudinal axis of said bow, said wheel having two opposite sides defining an elongated slot extending transversely therethrough and intersecting the central transverse axis of rotation of said wheel device, said device also including a bracket receiving said axle for rotation, said bracket being adjustably secured at a selected point along said slot, said sides defining therebetween a spaced pair of peripheral string grooves in the outer periphery of said wheel;

e) a cam secured to the lower end of said lower bow limb for rotation therearound along the longitudinal axis of said bow;

f) an elongated bowstring having an upper end releasably connected to one of said wheel sides and trained around said periphery in one of said wheel string grooves, the opposite end of said bowstring being releasably secured to said cam at said lower limb;

g) an elongated return string separate from said bowstring and having an upper end releasably secured to the other of said two wheel sides and trained around said periphery in the other of said two wheel string grooves, the opposite end of said return string being releasably secured to said cam at a point remote from said point of connection of said bowstring; and, h) a bow limb harness string having a bifurcated upper end releasably inter-connected to opposite sides of said wheel axle and a lower end releasably connected to said cam at a point remote from the points of connection of said bowstring and return string to said cam, said harness string preventing torquing of said bowlimbs during drawing and release of said bowstring.

7. The improved compound archery bow of claim 6 wherein said wheel sides define at least one supplemental slot extending transversely therethrough and not intersecting said central transverse axis of rotation.

8. The improved compound archery bow of claim 7 wherein said wheel sides define a plurality of said supplemental slots parallel to each other and a plurality of string anchors on each of said sides.

9. The improved compound archery bow of claim 6 wherein said cam comprises:

a) an irregularly-shaped disc cam aligned along the longitudinal axis of said bow and bearing a peripheral groove in which said bowstring is trained;

b) a smaller disc rigidly connected to one side of said bowstring cam and bearing a peripheral groove around which said return string is trained; and, c) a curved disc rigidly connected to said bowstring cam on the side opposite that to which said return string disc is connected and bearing a peripheral groove around which said harness string is trained, said cam being eccentrically connected to a transverse axle secured to the lower end of said lower bow limb for rotation in a direction along the longitudinal axis of said bow without torquing said bow limbs.

10. The improved compound bow of claim 9 wherein said harness string-receiving disc is demountable for substitution of a disc of different circumference.

11. The improved compound bow of claim 10 wherein said bowstring cam is generally hatchet-shaped, wherein said return string disc is generally ear-shaped and wherein said harness string-receiving disc is generally C-shaped.

* * * * *